United States Patent [19]

Buente et al.

[11] Patent Number: 4,470,381

[45] Date of Patent: Sep. 11, 1984

[54] HYDRAULIC TAPPET FOR DIRECT-ACTING VALVE GEAR

[75] Inventors: Stephen M. Buente, Kalamazoo; William T. Mihalic, Battle Creek, both of Mich.

[73] Assignee: Eaton Corporation, Cleveland, Ohio

[21] Appl. No.: 431,541

[22] Filed: Sep. 30, 1982

Related U.S. Application Data

[63] Continuation of Ser. No. 100,689, Dec. 5, 1979, abandoned.

[51] Int. Cl.[3] ..... F01L 1/24

[52] U.S. Cl. ..... 123/90.55; 123/90.51

[58] Field of Search ..... 123/90.48, 90.52, 90.55, 123/90.51, 90.56, 90.57, 90.58, 90.59

[56] References Cited

U.S. PATENT DOCUMENTS

| | | | |
|---|---|---|---|
| 3,509,858 | 5/1970 | Scheibe et al. | 123/90.27 |
| 3,877,446 | 4/1975 | Morgan | 123/90.55 |
| 4,184,464 | 1/1980 | Svihlik | 123/90.55 |
| 4,270,496 | 6/1981 | Narasimhan et al. | 123/90.51 |

FOREIGN PATENT DOCUMENTS

| | | | |
|---|---|---|---|
| 1808000 | 5/1970 | Fed. Rep. of Germany | 123/90.55 |
| 2758957 | 7/1979 | Fed. Rep. of Germany | 123/90.55 |
| 903983 | 8/1962 | United Kingdom | 123/90.27 |
| 1533654 | 11/1978 | United Kingdom | 123/90.55 |

*Primary Examiner*—Craig R. Feinberg
*Assistant Examiner*—W. R. Wolfe
*Attorney, Agent, or Firm*—C. H. Grace; J. G. Lewis

[57] ABSTRACT

A hydraulic lash adjusting tappet 10 for use in engine valve gear of the direct acting type having one end of the tappet contacting the end of the combustion chamber valve stem 26 and the other end contacting the camshaft lobe 16. The tappet has the body 40 formed with a tubular wall portion 42 having an inwardly extending web portion 44 intermediate the ends thereof with a tubular hub 46 disposed therewithin formed integrally with the web and extending axially therefrom. A cam face disc member 18 is attached about the periphery thereof to one end of the tubular wall. A plunger means 50 is slidably received in the tubular hub and includes a piston 64 slidable therein forming a high pressure chamber 86 within the plunger remote from the cam face and having therein one-way valve means for admitting fluid to the chamber for lash adjustment. An annular retainer 56 is received over the outward end of the hub and a passage 84 is provided through the tubular wall portion for communicating fluid to the reservoir.

7 Claims, 8 Drawing Figures

HYDRAULIC TAPPET FOR DIRECT-ACTING VALVE GEAR

This is a continuation of application Ser. No. 100,689, filed Dec. 5, 1979, now abandoned.

BACKGROUND OF THE INVENTION

In designing valve gear for internal combustion engines operating at speeds in excess of 5,000 rpm, it has been found desirable to employ valve gear of the cam-over-valve type. Valve gear of this type is known as direct-acting valve gear and employs a tappet having one end contacting the engine cam shaft with the other end of the tappet in direct contact with the end of the stem of the combustion chamber valve. Direct acting valve gear offers the advantage of low mass, fewer working parts and higher stiffness due to the elimination of the rocker arm and/or push rods. Low mass and high stiffness result in a high natural resonent frequency which allows the valve gear to attain higher rpms before valve mis-motion occurs. Direct acting valve gear also permits the use of lighter valve spring loads for a given valve motion and engine speed as compared with those used in other valve gear arrangements. The low mass and high stiffness of the system also permits valve lift velocities and accelerations which increase the area under the valve lift curve and thus provide increased specific engine output. Although other overhead cam configurations can be made to have comparable lift velocities and accelerations, a direct acting valve gear arrangement offers the additional advantage of permitting rotation of the cam contacting surfaces as the lifter rotates which is not possible with rocker arm type valve gear arrangements. Direct acting valve gear arrangements, therefore, allow higher permissible cam contact stresses.

In addition, the cam profile for other overhead cam valve gear arrangements with high lift accelerations and velocities is more complex than that required for direct acting valve gear. The simpler cam profile requirement of direct acting valve gear results in less manufacturing difficulties and less cost in the valve gear when high velocities and accelerations are desired.

It has, however, been found difficult to provide direct-acting valve gear in engine applications where the height of the engine must be kept to a minimum and consequently the cam shaft located closely adjacent the end of the combustion chamber valve stem. Furthermore, where it is desired to retrofit an hydraulic lash adjusting tappet into the direct-acting valve gear of a production engine, it is often difficult to provide a hydraulic lash adjusting tappet in the space provided between the cam shaft and the end of the valve stem. Since the tappet must be guided in a bore provided in the engine, it is necessary to provide structure intermediate the cam shaft and the end of the valve stem in order to provide the tappet guide bore and the engine height tends to somewhat increase.

Therefore, it has been desired to find an hydraulic lash adjusting tappet with a compact profile height for use in engines having direct acting valve gear with minimum distance between the cam shaft and the end of the valve stem to minimize the mass of engine structure necessary to provide the tappet guides. Furthermore, in designing tappets for direct acting valve gear so as to minimize side loading in the guide for minimizing wear, it is desirable to have the reaction force of the valve stem centered through the tappet at a point as closely adjacent the cam surface as possible. Locating the reaction force near the cam face also permits the tappet to be designed to minimize the mass, which in turn reduces inertia.

Known hydraulic tappets for direct-acting valve gear have employed a body, or bucket, formed as an integral unit having a reservoir provided by an undercut in the plunger guide bore formed in the bucket, such as that shown and described in U.S. Pat. No. 3,509,858 to Scheibe et al, wherein the necessity of undercutting requires a relatively large plunger guide bore in the body which in turn results in a reduced hydraulic pressure upper operating limit. Furthermore, if the diameter of the plunger guide bore is reduced, the undercut reservoir is reduced in volume and the mass of the tappet is increased, resulting in greater inertia.

Another problem encountered in designing hydraulic lash adjusting tappets for direct-acting valve gear has been the problem of providing means for retaining the hydraulic lash adjusting plunger sub-assembly in the tappet bucket prior to installation in the engine.

A further problem encountered in the design of such hydraulic bucket tappets has been the necessity of providing precision sliding surfaces on the outer diameter of the plunger and the inner periphery of the plunger guide bore formed in the bucket. Such precision surfaces are required in order to provide control of leakdown from the high pressure hydraulic chamber in the tappet where this sliding interface is employed as the leakdown control surface, as, for example, in the tappet described in German Pat. No. 1,914,693. In tappets having this latter known construction, the high pressure hydraulic fluid chamber for effecting lash adjustment is disposed at or near the upper level of the fluid reservoir and consequently is susceptable to retention of trapped air. This requirement for leakdown control has heretofore required extremely tight tolerances on the dimensions of the bucket bore and plunger diameter. The necessity of forming the plunger guide bore in the bucket to tight tolerances has resulted in costly scrap losses if such operations are defectively performed.

SUMMARY OF THE INVENTION

The present invention provides an hydraulic lash adjusting tappet of the type used in direct acting valve gear for internal combustion engines operating at high rpm. The hydraulic tappet of the present invention is of the type having a general configuration known as a "bucket" where the body of the tappet has a diameter substantially larger than that of the hydraulic plunger contained therein. The construction of the present tappet provides a low profile height for minimizing the distance required between the engine cam and the end of the combustion chamber valve stem. The present tappet further employs a unique construction whereby the primary leakdown surfaces from the high pressure chamber are formed between the plunger and a separate piston received therein rather than between the tappet body and the plunger. This construction enables the control of the clearances between the primary leakdown surfaces to be performed on the smaller diameter parts and eliminates the need for machining or grinding precision bore diameters in the tappet body. Scrap losses related to surfaces employed for leakdown control are therefore confined to the plunger piston subassembly.

The hydraulic tappet of the present invention provides for a relatively small lash adjustment plunger which reduces the load transmitted to the cam and valve at high engine lubricant supply operating pressures. The tappet of the present invention provides for an arrangement wherein the high pressure hydraulic lash adjustment chamber is disposed vertically near or below the lowest level of the hydraulic fluid reservoir to provide the most convenient escape path for any trapped air.

The body of the present tappet has a generally tubular outer wall construction with a radially inwardly extending web disposed intermediate the ends with a tubular hub disposed in the center of the body and formed integrally with the web and extending axially therefrom. The face of the tappet is provided by joining a generally disc-shaped member about its periphery to one end of the tubular outer wall portion. The hydraulic plunger and piston assembly is received in the inner hub and the hydraulic reservoir is formed between the inside face of the cam surface member, the outer tubular wall, the web, the inner tubular hub and the plunger. This unique construction provides for a relatively large diameter reservoir of fluid intermediate the hydraulic plunger and inner periphery of the outer wall portion without requiring undercutting of material in forming the tappet body. The resultant assembly of the tappet of the present invention gives a very low profile height for an hydraulic lash adjusting bucket tappet, yet provides relative ease of control in manufacturing of the leak-down surfaces and also yields an adequate reservoir of fluid for the hydraulic lash adjusting mechanism. The tappet of the present invention also provides means for trapped air escape and permits operation at high engine lubricant operating pressures. The tappet of the present invention also provides a unique means for retaining the hydraulic lash adjusting sub-assembly in the body.

DETAILED DESCRIPTION

Figure 1:
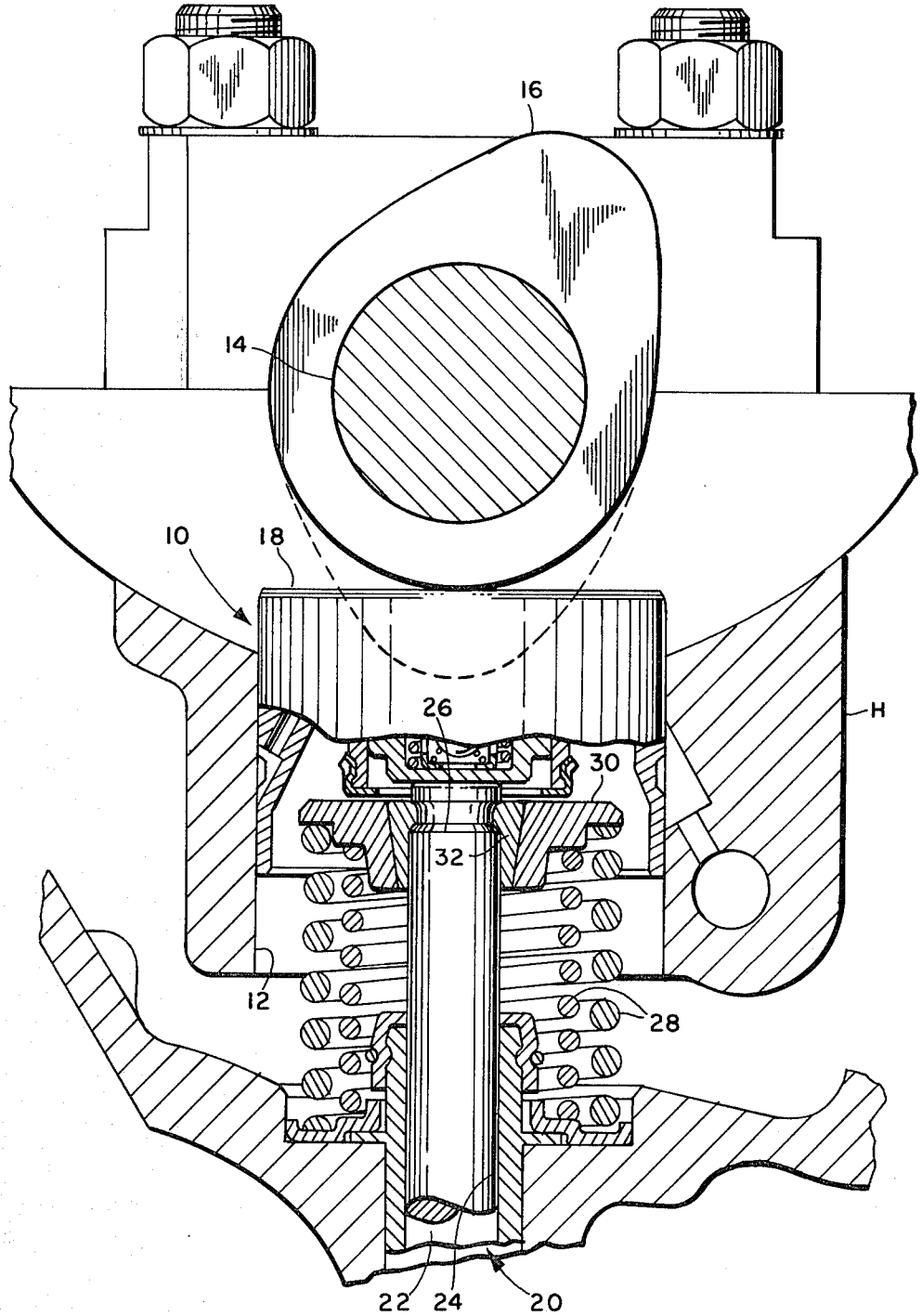
FIG. 1 is a cross section of a portion of the direct acting valve gear of an internal combustion engine illustrating the tappet as installed in the engine.

Referring now to FIG. 1, the bucket tappet indicated generally as 10 is slidably received in a guide bore 12 provided in the cylinder head H of the engine structure. A cam shaft 14 having a cam lobe 16 contacts the upper end or cam face 18 of the tappet. A typical combustion chamber valve 20 is shown seated on a valve seating surface formed in the cylinder head H with the stem portion 22 of the valve extending substantially vertically upward through a valve guide 24 formed in the cylinder head H, with the upper end 26 of the valve stem contacting the lower end of the tappet. The valve is biased to the closed position by a valve spring 28 having its lower end registering against the exterior of the upper portion of the valve guide 24 and its upper end in contact with a retainer 30 secured to the valve stem adjacent its upper end and retained thereon in a suitable manner as, for example, by the use of a split keeper 32 which is well known in the art.

Figure 2:
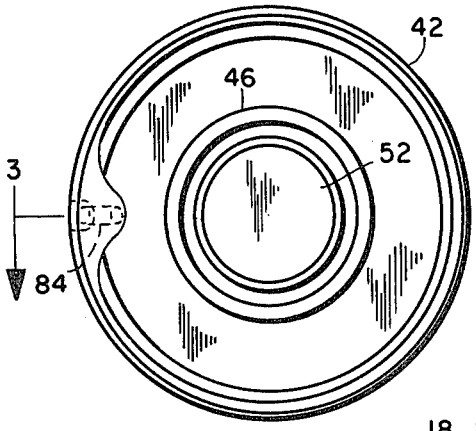
FIG. 2 is an end view of the plunger end of the hydraulic tappet of the present invention.
Figure 3:
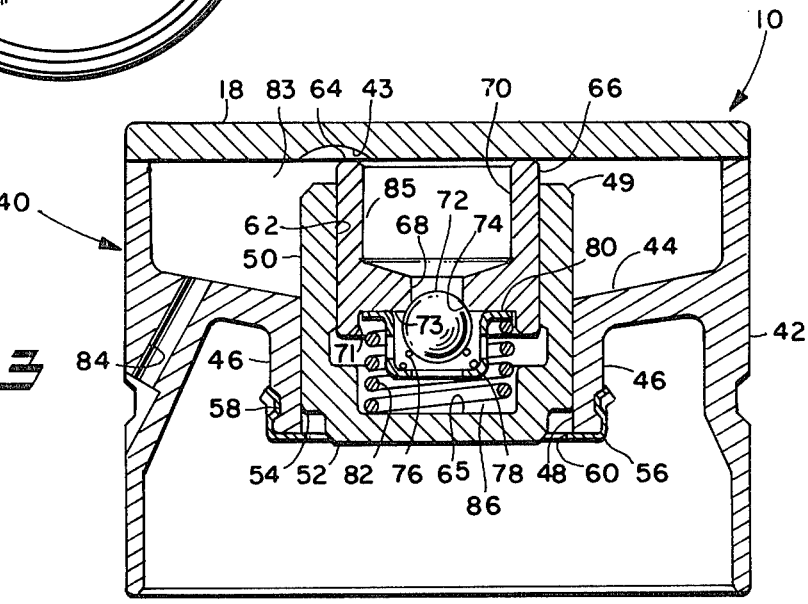
FIG. 3 is a cross section taken along section indicating line 3—3 of FIG. 2 and shows the tappet having the one-way valve means in the closed position.
Figure 4:
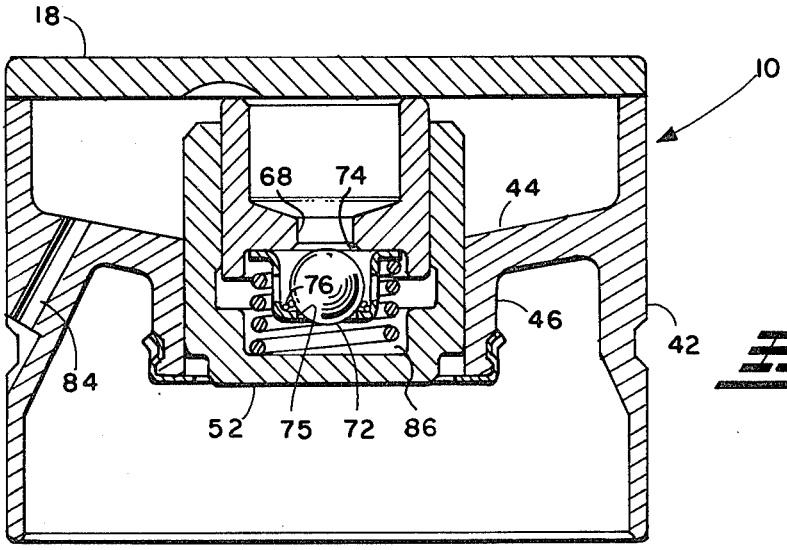
FIG. 4 is a view similar to FIG. 3 showing the one-way valve in the fully open position.

Referring now to FIGS. 2, 3, and 4, the presently preferred embodiment of the tappet 10 is shown wherein the body, indicated generally at 40, is shown as formed preferably integrally with an outer tubular wall portion 42 having a transverse web 44 extending generally radially inwardly from the inner periphery of the outer tubular wall portion 42 at a location intermediate the ends thereof. The web 44 has formed preferably integrally therewith a tubular hub portion 46 formed about the inner periphery of the web 44 with the hub 46 extending axially from the web in a downward direction with respect to FIG. 3. The hub 46 has the inner periphery thereof extending in generally parallel relationship to the outer periphery of the tubular wall portion 42. The outer periphery of the tubular wall portion 42 is sized to be received in the tappet guide bore 12 (see FIG. 1) in a generally closely fitting relationship. Although the outer wall, web and hub have been described as preferably formed integrally, it will be understood that such portions may be formed separately and the body formed by joining of those portions, as for example, by weldment, such as fusion or brazing.

In the presently preferred practice of the invention a cam face member 18 having a relatively thin disc-shaped configuration is joined about the outer periphery thereof with the upper end of the tubular body portion 42 in a suitable manner, as for example, laser fusion weldment. A fluid by-pass recess 43 is formed in the underface of member 18, the function of which will be hereinafter described. In the presently preferred practice the tappet cam face member is formed of a suitable alloy steel as, for example, an alloy containing a desired amount of chromium and is suitably hardened for wear resistance. The tubular body portion in the presently preferred practice is formed of a suitable iron base material as, for example, steel or cast iron. Although in the preferred practice the cam face member is formed of steel having a hardened surface, it will be understood that other metals, for example, nickel alloys may be used, or hardenable cast iron or ceramic materials or cermets may be employed if desired.

The inner periphery 48 of hub 46 has received therein a plunger 49 having the outer periphery thereof in sliding closely fitting relationship with the inner periphery 48 of the hub. The plunger 49 has the transverse face 52 thereof, or lower face with respect to FIG. 3, adapted for driving engagement with the end 26 (see FIG. 1) of the combustion chamber valve stem.

In the presently preferred practice, the plunger 49 is formed of steel with face 52 suitably hardened for wear resistance. The outer periphery 50 of the plunger 49 has an annular shoulder 54 formed thereon at the intersection with the lower face 52. An annular retainer 56 is received on the end of the hub 46 and engaged therewith, preferably in a groove 58 formed in the outer periphery of hub 46. The inner periphery 60 of the retainer 56 has a diameter intermediate that of the hub interior 48 and the inner diameter shoulder 54 such that the retainer 56 serves to limit the downward motion of the plunger 49.

The plunger 49 has a precision cylindrical bore 62 formed in the upper end thereof with the lower end thereof terminating in a shouldered flat bottom 65. The precision bore 62 has slidably received therein in very closely fitting relationship a piston member 64, the outer periphery 66 thereof being of precision diameter and smoothness so as to provide control of the leakdown or passage of pressurized engine lubricant therebetween. In the presently preferred practice the piston 64 is formed of a suitable steel material.

The piston 64 has a fluid passage 68 formed vertically and preferably centrally therethrough with a counterbore 70 formed therein. The bottom end of the passageway 68 has a counterbore 71 provided in the lower end of the piston 64 which counterbore has a flat bottom 73 which intersects the passageway 68 in an annular seating surface 74. A one-way valve member in the form of check-ball 72 rests against the annular seating surface 74, and is, as known in the art and described in the copending application of John J. Krieg, Ser. No. 093,782, filed Nov. 13, 1979, now abandoned, and assigned to the assignee of the present invention, biased thereagainst by a suitable expedient as, for example, a conical check-ball spring 76. The check-ball 72 is retained by the cage 78 which has an outwardly extending flange 80 received in counterbore 71 and retained therein by suitable means as, for example, a press fit. The cage 78 in the presently preferred practice has a central aperture 75 into which the check-ball 72 is partially received in the valve fully open position as shown in FIG. 4 and as described in the aforesaid patent application of J. Krieg. The subassembly of the check-ball, cage and piston is biased upwardly by a plunger spring 82 having its upper end registering against the flange 80 of the check-ball cage and its lower end contacting the bottom 64 of the plunger.

The area surrounding the plunger 49 above the web 44 and bounded by the under surface of cam face member 18 comprises a first portion 83 fluid reservoir which is communicated with the region externally of the body periphery 42 by a passageway 84 provided through the outer tubular wall 42 of the tappet body and the web 44. The by-pass recess 43 functions to maintain the second portion 85 of the reservoir bounded by piston bore 70 and the underface of member 18 in continuous fluid communication with the outer regions 83 of the reservoir. It will be understood the piston is maintained in the upward extreme position and against the undersurface of member 18, as illustrated in FIGS. 3 and 4 by spring 82 and the hydraulic pressure in chamber 86.

In the presently preferred practice, the fluid retained in the second portion 85 of the fluid reservoir supplies the one-way valve 72 upon engine start-up in the event that during periods of engine inactivity, fluid has drained from the first portion 83 of the reservoir.

The region 86 below the piston check-ball 72 and seat 74 are bounded by the bore 62 of the plunger 49. The bottom 65 of the plunger comprises a high pressure fluid chamber for retaining therein fluid entering through passage 68 upon opening of the check-ball 72.

In operation, the valve 72 is biased in a closed position by spring 76 and upon rotation of the cam shaft in timed relationship to the events of the combustion chamber to the position shown in solid outline in FIG. 1, the upper surface of the tappet is registered against the base circle portion of the cam with the lobe 16 oriented so as not to contact the cam face 18 of the tappet. Upon rotation of the cam shaft 14 to the position shown in dashed outline in FIG. 1, the cam load contacts the upper face 18 of the tappet, causing the tappet to move downwardly to the position indicated in dashed outline thereby opening the combustion chamber valve. Upon subsequent rotation of the cam shaft to return to the solid outline position of FIG. 1, the valve event is complete and the valve is reseated on the valve seat.

In operation, with the engine cam lobe 16 in the position shown in FIG. 1, the plunger spring 82, aided by hydraulic pressure, maintains the upper end of piston 64 in contact with the undersurface of cam face member 18 and urges the plunger 49 in the downward direction until the end face 52 thereof contacts the upper face 26 of the valve stem 22 thereby eliminating lash in the valve gear. This causes expansion of chamber 86 which draws open the check-ball 72 to the position shown in FIG. 4 permitting fluid to flow into chamber 86. Upon cessation of the expansion of chamber 86, the check-ball 72 closes under the biasing spring 76. Upon subsequent rotation of the cam lobe 16, the ramp of the cam lobe begins to exert a downward force on the upper face 18 of the tappet tending to compress the piston 64 into bore 62 in the plunger, which compression is resisted by fluid trapped in chamber 86. The fluid trapped in the chamber 86 prevents substantial movement of the piston 64 relative to plunger 49 and transmits the motion through the bottom face of plunger 49 onto the top of the valve stem 26. It will be understood by those having ordinary skill in the art that a minor movement of the plunger with respect to the piston occurs, the magnitude of which is controlled by the amount of fluid permitted to pass through the aforesaid leakdown surfaces 62 and 66. The piston 64 and plunger 49 thus act as a rigid member transmitting further lifts of cam lobe 16 for opening the valve to the position shown by dashed line in FIG. 1.

Figure 5:
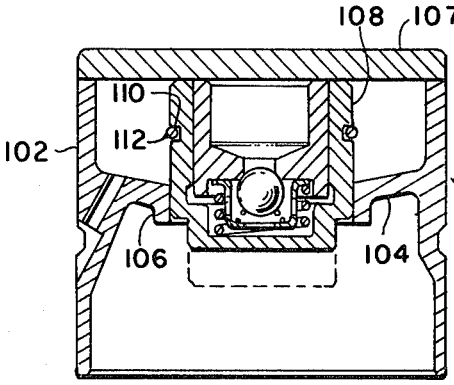
FIG. 5 is a view similar to FIG. 3 showing a portion of another embodiment of the tappet employing an alternate retaining means for the plunger.

Referring now to FIG. 5, an alternate embodiment of the tappet is shown generally at 100 as employing a tubular outer wall 102 having an inwardly extending web 104 integrally formed therewith and a central tubular hub portion 106 formed integrally with the web 104. A plunger 108 is slidably received in the hub 106. The plunger has a hydraulic piston and one-way valve means similar to that of embodiment of FIG. 3, and the outer tubular wall 102 has the one end thereof closed by a cam face member 107. The plunger 108 in the embodiment of FIG. 5 has a circumferential groove 110 formed about the periphery thereof with a radially compressible-expandable generally C-shaped snap-ring 112 received therein.

In assembling the embodiment of FIG. 5, the plunger assembly with the ring 112 received thereon is piloted into the inner periphery of the hub 106, the ring 112 is then compressed such that its outer circumference is less than the inner periphery of the hub. The plunger is then moved upward with respect to FIG. 5 until the snap ring 112 passes through the hub 106 and then is free to expand slightly so as to retain the plunger assembly from removal from the hub. It will be recognized that the embodiment of FIG. 5 eliminates the need for the forming of a groove, such as groove 58, in the wall of the hub 46 (see FIG. 3) which results in difficult manufacturing operations in forming such groove particularly when the outer diameter of the body is less than 35 mm. The embodiment of FIG. 5 however, results in a tappet assembly in which the plunger subassembly is potentially more difficult to remove.

Figure 6:
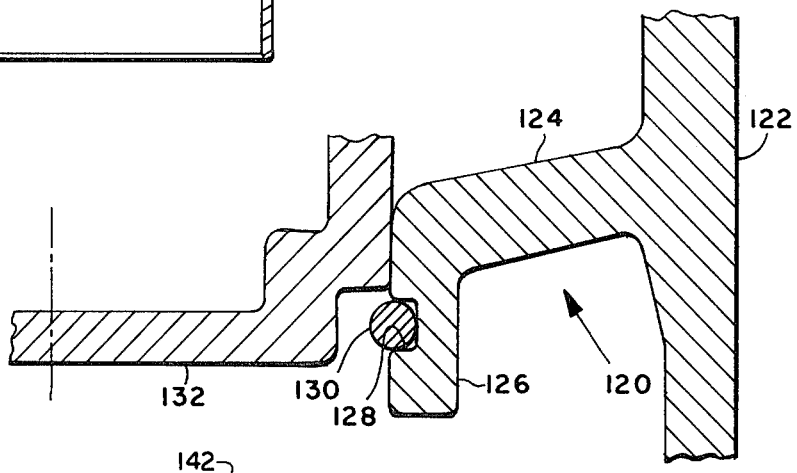
FIG. 6 is a view similar to FIG. 5 showing an additional embodiment of the tappet employing a third plunger retaining means.

Referring now to FIG. 6, a further alternate embodiment of the invention is illustrated wherein portions of the tappet indicated generally at 120 are shown. The body of the tappet of FIG. 6 has an outer tubular wall portion 122 and a transverse web 124 having integrally formed therewith a central tubular hub 126 extending axially downwardly from the web 124. The inner periphery of the hub 126 has a circumferential groove 128 formed therein adjacent the lower end thereof with a retaining means in the form of a snap ring 130 received therein for retaining the plunger 132 in the hub.

Figure 7:
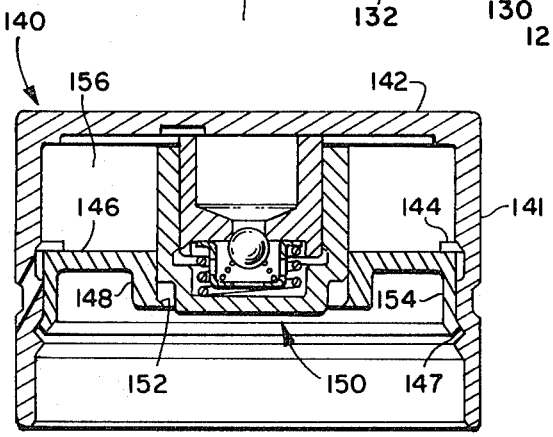
FIG. 7 is a view similar to FIG. 3 showing another embodiment of the tappet having an alternate version of the body.

Referring now to FIG. 7, an alternate embodiment of the tappet 140 is illustrated having a body outer tubular wall portion 141 closed at the upper end thereof by transverse web 142 having the upper surface thereof hardened for contacting a cam. The web 142 is preferably formed integrally with the outer wall 141 and of a suitable iron base material such as a readily formable and hardenable steel. The outer wall 141 has a preferably annular rib 144 extending from the inner surface thereof intermediate the ends of the outer wall portion and has a circumferential groove 147 formed in the inner periphery of the wall portion 141 and spaced vertically downward in FIG. 7 from the rib 144. An annular member 146 formed of a suitable iron base material as, for example, an unhardened carbon steel, is received in the inner periphery of the wall 141 with the upper surface of annular member 146 registering against the lower surface of annular rib 144. The annular member 146 has a downwardly extending annular hub portion 148 formed integrally therewith and centrally disposed with respect thereto which hub portion 148 has received therein a suitable hydraulic lash-adjusting assembly indicated generally at 150 and which is similar to the assembly shown and described hereinabove with respect to FIGS. 3, 4 and 5. The hydraulic lash-adjusting assembly 150 is retained in the inner periphery of hub 148 by deformation of the lower edge of the hub inwardly to form the lip 152.

The outer periphery of annular member 146 has an annular wall portion 154 extending downwardly with respect to FIG. 7 from the outer periphery of the annular member 146 and along the inner surface of the wall portion 141 of the tappet body. The lower edge of wall 154 is deformed outwardly into the groove 147 to retain the annular member 146 registered against the undersurface of rib 144 and to prevent removal of the annular member 146 from the tappet body. The annular member 146 thus defines an outer annular portion 156 of the hydraulic fluid reservoir similar to the portion 83 of the embodiment of FIG. 3. The function of the hydraulic lash-adjusting mechanism 150 in tappet 140 is otherwise identical to that described hereinbove with respect to the embodiments of FIGS. 2 thru 5. The embodiment of FIG. 7 provides a simplified structure for the bucket or tappet body; however, a separate insert member is required to provide for the outer portion of the fluid reservoir and the supporting hub for the lash-adjusting mechanism.

Figure 8:
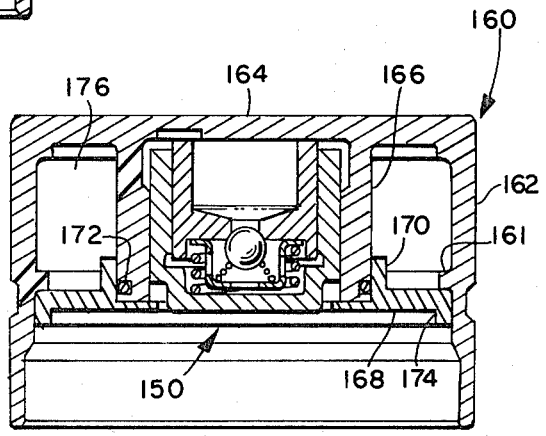
FIG. 8 is a view similar to FIG. 3 showing still another version of the body.

Referring now to FIG. 8, another embodiment of the tappet is denoted generally at 160 which employs the body having an outer tubular wall portion 162 with a transverse web 164 closing the upper end therefor with respect to FIG. 8 and providing on the upper surface of the web 164, a suitably hardenable surface for contacting a cam. In the presently preferred practice of the invention the outer wall 162 and web 164 are formed of a suitably hardenable iron base material as, for example, a suitable carbon steel. An inner tubular hub 166 is joined with the undersurface of web 164 and extends downwardly therefrom in FIG. 8 and is disposed generally centrally with respect thereto. The inner periphery of the hub 166 has received therein an hydraulic lash adjusting sub-assembly 150 in the same manner and function as in the embodiment described above with respect to FIG. 7. In the embodiment of FIG. 8 an annular member 168 is received in contact with the inner periphery of the outer wall 162 and registers against an annular rib 161 formed on the inner periphery of wall 162. Annular member 168 has upper surface thereof in the region adjacent the inner periphery registering against the end of hub 166 with an annular wall portion 170 extending upwardly over the outer periphery of the hub 166. A seal member 172 is received in a groove provided in the outer periphery of hub 166, which seal member provides a seal between the hub and inner periphery of annular wall 170. In the presently preferred practice of the invention the annular member, including wall 170, is formed of a light-weight relatively soft material as, for example, aluminum, which is retained in the inner periphery of the body by suitably staking the outer periphery of the member 168 radially outwardly in the rim portion 174 provided about the outer periphery thereof. The embodiment of FIG. 8 thus provides a tubular hub formed integrally with the web and outer wall to provide relatively hard sliding surfaces for the inner periphery of the hub to which the lash adjuster 150 is received. The embodiment of FIG. 8 enables the use of an annular member formed of soft material such as aluminum for closing the outer annular portion 176 of the fluid reservoir. The embodiment of FIG. 8 is otherwise functionally similar to the embodiments of FIGS. 2 thru 7.

The present invention, as described and illustrated in the foregoing embodiments, provides a unique bucket tappet for use in direct acting valve gear of internal combustion engines and it is particularly suitable for operating speeds in excess of 5,000 rpm. The present tappet employs a hardened steel disc attached over one end of a tubular body for providing the cam face of the tappet. The tubular body has formed integrally therewith an inwardly extending web disposed intermediate the ends of the tubular wall, with the web having formed integrally therewith a centrally disposed tubular hub for receiving the hydraulic lash adjusting plunger mechanism. The plunger mechanism is retained preferably by retaining means engaging the wall of the tubular hub or alternatively, by snap ring provided in the outer periphery of the plunger. The novel construction of the present tappet provides the lash adjustment by a precision fit of a piston in a bore formed in the plunger slidably received in the hub, and thus eliminates the need for precision fitting leakdown control surfaces on the interior of the tappet hub. The area surrounding the plunger between the web and tubular wall of the body and the cam face member provides a first portion of a reservoir and a cavity in the piston provides a second portion reservoir for fluid to supply the one-way check valve for the hydraulic lash adjusting means. The external retaining means in the preferred embodiment permits ease of manufacturing and ready removal of the hydraulic plunger assembly for cleaning and/or parts replacement.

Although the invention has been described and illustrated hereinabove in the presently preferred practice, it will be apparent to those having ordinary skill in the art that modifications and variations of the invention may be made to the forms disclosed herein and the invention is limited only by the following claims.

We claim:

1. A bucket tappet for the valve gear of an internal combustion engine of the type having one end of the tappet adapted for direct contact with the stem of the combustion chamber valve and the opposite end adapted for direct contact with the cam lobe, said bucket tappet comprising:

(a) a body member having a tubular wall portion with an outer periphery thereof adapted for being slidably received in a tappet guide surface formed in the engine, said body having a web portion formed integrally with said tubular wall portion intermediate the ends thereof and extending inwardly therefrom, and a tubular hub portion formed integrally with said web, said hub having the inner periphery thereof disposed in generally parallel relationship to the outer periphery of said wall portion, said hub portion having one end thereof extending axially in at least one direction beyond said web, said extended portion defining a substantial part of said inner periphery to establish an axial guide surface;

(b) a cam face member having a generally disc-shaped configuration with one face thereof adapted for contacting the engine cam, said face member being disposed across one end of said tubular wall portion and secured thereto about the periphery thereof in a fluid pressure sealing manner, said hub portion terminating at the end thereof nearest said cam face member in an axially spaced relationship therewith;

(c) plunger means slidably received by the guide surface in said hub portion in closely fitting relationship wherein said plunger means, said hub portion, said web, said tubular wall portion and said cam face member cooperate to define a fluid reservoir having an outer annular chamber and a central chamber, said plunger means including a member having an end face remote from said cam face and adapted for directly contacting the stem end of a combustion chamber valve, said plunger means having received therein hydraulic lash adjusting means communicating with said reservoir and operable upon installation in an engine tappet guide bore and being provided with a supply of pressurized fluid to said reservoir, to adjust the distance between said plunger end face and said cam face upon relaxation of said engine valve timing force thereon for adjusting lash between the valve stem and cam;

(d) said hydraulic lash adjusting means having surface portions thereof cooperating with adjacent surface portions of said cam face member to provide a passage interconnecting said central and annular chambers; and, (e) retaining means operable to retain said plunger means in said hub.

2. A bucket tappet for the valve gear of an internal combustion engine of the type having one end of the tappet adapted for direct contact with the stem of the combustion chamber valve and the opposite end adapted for direct contact with the cam lobe, said bucket tappet comprising:

(a) body means defining a tubular wall with an outer periphery thereof adapted for being slidably received in a tappet guide surface formed in the engine, said body means defining a web formed integrally with said tubular wall intermediate the ends thereof and extending inwardly therefrom, and said body means further defining a tubular hub formed integrally with said web, said hub having the inner periphery thereof disposed in generally parallel relationship to the outer periphery of said wall, said hub having one end thereof extending axially in at least one direction beyond said web, said extended portion defining a substantial part of said inner periphery to establish an axial guide surface;

(b) said body means including structure defining a cam face generally transverse to said tubular wall across one end thereof and adapted for contacting the engine cam, said hub terminating at the end thereof nearest said cam face structure in an axially spaced relationship therewith;

(c) plunger means slidably received by the guide surface in said hub portion in closely fitting relationship wherein said plunger means, said hub portion, said web, said tubular wall portion and said cam face structure cooperate to define a fluid reservoir having an outer annular chamber and a central chamber, said plunger means having therein hydraulic lash adjusting means communicating with said reservoir and operable upon installation in an engine tappet guide bore and being provided with a supply of pressurized fluid to said reservoir, to adjust the distance between said plunger end face and said cam face upon relaxation of engine valve timing force thereon for adjusting lash between the valve stem and cam; and, (d) said cam face structure and said lash adjusting means each having surface portions thereof cooperating to define a passage interconnecting said central and annular chambers; and, (e) retaining means and operable to retain said plunger means in said hub.

3. A bucket tappet for a valve gear of an internal combustion engine comprising:

(a) body means including structure defining a generally cylindrical tubular outer wall having an outer periphery thereof adapted to be received in sliding engagement with a guide surface provided in the engine and including structure defining a face generally transverse to the cylindrical periphery and adapted to contact a timed cam, said body means including web structure formed integrally with said outer wall and extending inwardly from said outer tubular wall, said body means further including hub structure formed integrally with said web structure and having the wall thereof disposed in generally parallel relationship to said outer periphery, said web structure being operative to position and support said hub within said outer tubular wall, said hub structure having one end thereof extending axially in at least one direction beyond said web and terminating at the end thereof nearest said cam face structure in an axially spaced relationship therewith;

(b) plunger means slidably received in said tubular hub, said plunger means including structure defining a piston bore with a piston slidably received therein in precision closely fitting relationship thereto, said piston and said plunger means cooperating to define a fluid pressure chamber wherein said closely fitting relationship of said piston in said piston bore is operative to control leakdown from said chamber upon application of an axial load on said piston tending to urge said piston in a direction to compress fluid in said chamber;

(c) one-way valve means disposed in said piston and operable to permit flow of fluid into said chamber upon movement of said piston in a direction outwardly of said piston bore, said valve means being operable to prevent opposite flow therethrough upon movement of said piston in a direction tending to decrease volume of said chamber;

(d) means biasing said piston in a direction outwardly of said piston bore;

(e) said plunger means, said hub, said web, said outer wall and said cam face defining structure cooperating to define a fluid reservoir for supplying fluid to said one-way valve means, said reservoir including an annular chamber surrounding said plunger means and a central chamber disposed within said plunger means and adjacent said cam face defining structure, said central and annular chambers being interconnected by a fluid passage defined by the cooperation of portions of said cam face defining structure and said piston; and, (f) said body means defining a fluid passage communicating said cylindrical outer periphery with said fluid reservoir.

4. A bucket tappet for a valve gear of an internal combustion engine comprising:

(a) body means including structure defining a generally cylindrical tubular outer wall having an outer periphery thereof adapted to be received in sliding engagement with a guide surface provided in the engine and including structure defining a face generally transverse to the cylindrical periphery and adapted to contact a timed cam, said body means including web structure formed integrally with said outer wall and extending inwardly from said outer tubular wall, said body means further including hub structure formed integrally with said web and having the wall thereof disposed in generally parallel relationship to said outer periphery said hub wall defining structure extending axially in at least one direction beyond said web and terminating at the end thereof nearest said cam face defining structure in an axially spaced relationship therewith, said web structure being operative to position and support said hub within said outer tubular wall;

(b) plunger means slidably received in said tubular hub, said plunger means including structure defining a piston bore with a piston slidably received therein in precision closely fitting relationship thereto, said piston and said plunger means cooperating to define a fluid pressure chamber wherein said closely fitting relationship of said piston in said piston bore is operative to control leakdown from said chamber upon application of an axial load on said piston tending to urge said piston in a direction to compress fluid in said chamber;

(c) one-way valve means disposed in said piston and operable to permit flow of fluid into said chamber upon movement of said piston in a direction outwardly of said piston bore, said valve means being operable to prevent opposite flow therethrough upon movement of said piston in a direction tending to decrease volume of said chamber;

(d) means biasing said piston in a direction outwardly of said piston bore;

(e) retaining means operable to retain said plunger means in said tubular bore;

(f) said plunger means, said hub, said web, said outer wall and said cam face defining structure cooperating to define a fluid reservoir for supplying fluid to said one-way valve means, said reservoir including an annular chamber surrounding said plunger means and a central chamber disposed within said plunger means and adjacent said cam face defining structure, said central and annular chambers being interconnected by a fluid passage defined by the cooperation of portions of said cam face defining structure and said piston; and, (g) said body means defining a fluid passage communicating said cylindrical outer periphery with said fluid reservoir.

5. The device defined in claim 4, wherein said retaining means comprises an annular member engaging the outer periphery of said hub structure wall.

6. The device defined in claim 4, wherein said hub structure inclues a circumferential groove formed in the outer periphery thereof and said retaining means comprises an annular spring clip engaging said circumferential groove.

7. The device defined in claim 4, wherein said retaining means comprises an annular member received over the end of said hub remote from said closed end of said body.

* * * * *